United States Patent [19]

Stoetzer

[11] Patent Number: 4,518,524

[45] Date of Patent: May 21, 1985

[54] SILVER COATING COMPOSITION FOR USE IN ELECTRONIC APPLICATIONS AND THE LIKE

[75] Inventor: Steven R. Stoetzer, Port Huron, Mich.

[73] Assignee: Acheson Industries, Inc., Port Huron, Mich.

[21] Appl. No.: 508,286

[22] Filed: Jun. 27, 1983

[51] Int. Cl.[3] ..... H01B 1/02

[52] U.S. Cl. ..... 252/514; 252/513; 252/512; 252/516; 524/439; 524/440; 523/137

[58] Field of Search ..... 252/513, 514, 518, 516; 106/1.05, 1.18, 1.19, 311, 290; 524/439, 440

[56] References Cited

U.S. PATENT DOCUMENTS

| | | | |
|---|---|---|---|
| 3,484,284 | 12/1969 | Dates et al. | 252/513 |
| 3,709,835 | 1/1973 | Forster | 252/513 |
| 3,904,555 | 9/1975 | Matsuda et al. | 252/513 |
| 4,197,218 | 4/1980 | McKaveny | 252/513 |
| 4,390,458 | 6/1983 | McKaveney | 252/513 |

*Primary Examiner*—Josephine L. Barr

*Attorney, Agent, or Firm*—Harness, Dickey & Pierce

[57] ABSTRACT

A new silver dispersion coating composition containing a special additional pigment material useful as an electrically conductive coating on electronic equipment or the like. The new coating composition maintains high electrical conductivity at a significant economic advantage over similar prior coating compositions.

16 Claims, No Drawings

SILVER COATING COMPOSITION FOR USE IN ELECTRONIC APPLICATIONS AND THE LIKE

BACKGROUND OF THE INVENTION

This invention relates to a new coating composition, usable as a conductive coating. More particularly, this invention relates to a new silver dispersion coating composition that maintains high electrical conductivity even after exposure to elevated temperatures and humidity during operation. The new coating composition of this invention may be applied by silk screening, spraying, brushing, dipping, roller coating, or the like.

The state of the art is indicated by the following U.S. Pat. Nos. 4,371,459; 3,562,124; 3,099,578; 4,101,710; 3,920,452; and 3,412,043; and European Patent Application No. 0,068,168.

It has been generally known that noble metal particles, such as copper, silver gold and the platinum group metals, dispersed in a binder resin material or solution could be used to make electrically conductive coatings. However, all of these prior coatings have suffered from various deficiencies. Copper, for example, oxidizes during storage or use and the electrical properties of the coating are detrimentally effected. The use of silver, gold or platinum as the conductive material in sufficient quantity to insure good electric conductivity greatly increases the cost of the electrically conductive coating.

The demands for conductive compositions are significantly increasing with increased emphasis on performance characteristics such as durability under harsh environmental changes, ability to use these compositions at increased temperatures, greater abrasion resistance and the like. At the same time, and more importantly, lower processing costs and product costs with increased product capabilities have long been sought.

Accordingly, a main object of this invention is to provide a new conductive coating composition containing finely divided silver particles which is suitable for use in forming applied coatings having very good electrical conductance properties, and which composition is considerably more economical to produce than prior coatings having similar performance characteristics.

Another important objective of this invention is to provide a new silver coating composition which when applied as a coating maintains high electrical conductivity even after exposure to heat, humidity, or other harsh environmental conditions.

Another object of the invention is to provide a new silver coating composition that includes a special additional pigment component.

An additional object of this invention is to provide a new silver-containing composition which has a desirable magnetic property.

Other objects, features and advantages of the present invention will become apparent from the subsequent description and the appended claims.

SUMMARY OF THE INVENTION

A significant purpose of this invention is to describe an electrically conductive coating composition containing silver particles and a special additional pigment component which has highly useful electrical conductance properties and is considerably more economical to produce than prior coating compositions having essentially similar performance characteristics. These new compositions retain highly useful electrical conductance properties after exposure to elevated temperature for significant periods of time. Elevated temperatures include temperatures in excess of 200° F. In addition, the new coating composition exhibits generally excellent flexibility as determined by measuring conductivity before and after folding a 1 mil thick coating applied to a plastic film substrate. The uses for these new coating compositions include silk screening applications where a highly conductive patterned coating is needed, and where an electromagnetic interference shielding coating is needed.

Numerous prior art deficiencies have been overcome through the discovery that if finely divided silver particles are co-mixed with special refractory ferro alloys as described herein, the electrical conductance properties of the deposited film are maintained with very good characteristics (approaching that of a 100% pure silver only composition), while the coating itself can be manufactured at a significantly reduced cost over prior coating compositions.

DESCRIPTION OF PREFERRED EMBODIMENTS

While is is not fully understood as to why the invention operates to provide such significantly useful electrically conductive silver coatings, the following preferred embodiments and preferred aspects of the invention will now be described.

The silver pigment material used in the coating composition is substantially of silver. The silver particles used herein can be of either flake or nonflake morphology. The nonflake powders can be irregularly shaped or spherical. However, flake silver powders are preferred due to their greater contribution to conductivity and dispersibility. Flake morphology should be understood to mean silver powder whose predominate shape is flake as determined by scanning electron microscopy. The silver pigment particle size broadly stated should be under about 50 microns in average particle size. Such silver flake powders typically have a surface area of approximately 0.80–1.40 $m^2$/gram and over 99% purity. Small amounts of other conductive metals such as nickel, copper and the like may also be present in amounts of about 2–3% or less by weight without substantially effecting performance characteristics. However, on a preferred basis, the silver pigment used herein is 99+% in purity. Although silver particles are preferred, conductor coated materials such as silver-coated glass beads, silver-coated copper particles and the like can also be used.

The additional pigment material used in the composition, which has been found to give very good properties to the coating is a refractory ferro alloy. Such ferror alloys include materials which are selected from at least one of the group consisting of ferrophosphorous, ferromanganese, ferromolybdenum, ferrosilicon, ferrochrome, ferrovanadium, ferrozirconium, ferrotitanium, ferrotungsten, ferroboron and ferrocarbide or iron carbide. The ferro alloys discovered for use herein are described in U.S. Pat. No. 3,562,124, the disclosure of which is incorporated herein by reference.

Of the refractory ferror alloys indicated hereinabove, the preferred material is ferrophosphorous, and especially preferred is di-iron phosphide. The preferred ferrophosphorous refractory ferro alloy is an iron phosphide composition, generally containing from about 20 to 28% by weight of phosphorous and corresponding to a mixture of $Fe_2P$ and FeP. The principal impurities occurring in ferrophosphorous are silicon, vanadium, chromium, nickel and manganese, as well as trace amounts of other elements. Of these, silicon and manganese are the major impurities, typically being present in amounts up to about 7% by weight. Ferrophosphorous is commercially available from the Hooker Chemicals and Plastics Corp. under trademark Ferrophos ® and is usually denominated di-iron phosphide.

The ferro alloy component of the present coating composition is a powder preferably having a random and angular particle shape. The particles of the ferro alloy constituent have an average particle size less than about 70 microns on a broad basis, and preferably less than about 30 microns. Best results are obtained where the average particle size is less than about 20 microns.

The ferro alloy used in the composition is present within the broad range of about 5% to about 90% by weight of the total pigment material in the composition. Preferably it is within the range of about 20% to about 80% by weight of the pigment material, and best results are obtained within the range of about 20% to about 70%.

The solvent carrier used with the coatings are conventional organic solvents or solvent blends useful for dissolving or dispersing the binder resin which will subsequently be described. The solvent used is one which is compatible with the binder resin, silver particles, and ferro alloy particles. Broadly stated, solvents such as ketones, acetates, ethers, aromatics, and chlorinated solvents can be used. Preferably, solvents such as ethylene glycol phenyl ether, benzyl alcohol, glycol ether acetates, and Carbitol ® acetate may be used. Cellosolve ® acetate, butyl Cellosolve ® acetate and butyl Carbitol ® acetate are especially preferred. Cellosolve ® and Carbitol ® are registered trademarks of Union Carbide Corporation.

The binder resin used in the coating composition may be any of a number of different materials. The binder resin may be a thermoplastic resin material which is compatible with the silver particles and with the ferro alloy material used in the coating composition. Thermosetting resin materials may also be used as the binder resin herein. The binder resin broadly stated is selected from at least one of the group consisting of thermoplastic acrylic, vinyl, urethane, alkyd, polyester, hydrocarbon, fluoroelastomer and cellulosic resins; and thermosetting acrylic, polyester, epoxy, phenolic, urethane, and alkyd reins. Vinyls, polyesters, and acrylics are preferred and polyester is especially preferred. The particular binder resin material chosen may be dictated by the desired application method and must also be compatible with the substrate.

The pigment to binder ratio by weight in the coating composition of this invention should broadly be within the range between about 20 to 1 and about 2 to 1. Preferably it should be maintained in the range between about 10 to 1 and about 4 to 1, and best results are obtained between about 8 to 1 and about 5 to 1.

Another material which may optionally be present in the coating composition is hydroquinone. It is believed the addition of hydroquinone helps to further lower the electrical resistance of the final cured coating. Purified hydroquinone in finely divided form is preferred.

When used, hydroquinone may be present in an amount of up to about 1% by weight based upon the amount of silver present.

The percent total solids in the coating composition of the present invention should broadly be within the range of about 35% up to about 100% by weight. Preferably, it should be within the range of about 50% to about 85% and best results are obtained at about 60% to about 80% by weight.

The properties of the new coating composition as referred to herein are believed to be highly advantageous and unique. Broadly stated, the conductivity of the coating is within the range of about 0.001 to about 30 ohms per square at 1 mil. On a preferred basis, the conductivity is within the range of about 0.010 to about 5 ohms per square at 1 mil, and particularly preferred embodiments exhibit conductivity of about 0.020–2 ohms per square at 1 mil.

It has been found that the new coating compositions disclosed herein exhibit generally excellent flexibility, abrasion resistance, adhesion, humidity resistance, and heat resistance properties; and, the coating also has a reduced tendency for silver migration to occur.

In order to further illustrate the invention, the following examples are provided. It is to be understood however that the examples are included for illustrative purposes and are not intended to be limiting of the scope of the invention as set forth in the subjoined claims.

EXAMPLE NO. 1*

*In all Examples, all amounts shown are in parts by weight.

| | | |
|---|---|---|
| Goodyear Tire & Rubber Co. Vitel ® PE-307 Polyester Resin | | 7.50 |
| Goodyear Tire & Rubber Co. Vitel ® PE-200 Polyester Resin | | 3.22 |
| Cellosolve ® Acetate | | 24.96 |
| Hydroquinone | | 0.06 |
| Hooker Corp. Ferrophos ® 2131 Di-Iron Phosphide | | 12.85 |
| Silver Flake | | 51.41 |
| Formulating Procedure: | (1) | Predissolve Vitel ® PE-307, Vitel ® PE-200 and Hydroquinone in Cellosolve ® Acetate using propeller mixer |
| | (2) | Stir in Di-iron Phosphide and Silver Flake using propeller mixer |
| | (3) | Pass through Three Roll Mill once |
| Standardized Application and Evaluation Procedure: | (1) | Two mil Drawdown onto Mylar ®** Film |
| | (2) | Cure 30 minutes at 160° F. |
| Results for 1 mil thick applied coating: Electrical resistance of .027 ohms per square at 1 mil. | | |

**Mylar ® is a registered trademark of E. I. duPont de Nemours and Company, Inc.

EXAMPLE NO. 2

| | |
|---|---|
| Goodyear Tire & Rubber Co. Vitel ® PE-307 Polyester Resin | 7.50 |
| Goodyear Tire & Rubber Co. Vitel ® PE-200 Polyester Resin | 3.22 |
| Cellosolve ® Acetate | 24.96 |
| Hydroquinone | 0.06 |
| Hooker Corp. Ferrophos ® 2131 Di-Iron Phosphide | 19.28 |
| Silver Flake | 44.98 |
| Formulating procedure same as Example 1. | |
| Results for 1 mil thick applied coating: Electrical resistance of .053 ohms per square at 1 mil. | |

EXAMPLE NO. 3

| | |
|---|---|
| Goodyear Tire & Rubber Co. | 7.50 |
| Vitel ® PE-307 Polyester Resin | |
| Goodyear Tire & Rubber Co. | 3.22 |
| Vitel ® PE-200 Polyester Resin | |
| Cellosolve ® Acetate | 24.96 |
| Hydroquinone | 0.06 |
| Hooker Corp. Ferrophos ® 2131 | 25.70 |
| Di-Iron Phosphide | |
| Silver Flake | 38.56 |

Formulating procedure same as Example 1.
Results for 1 mil thick applied coating:
Electrical resistance of .064 ohms per square at 1 mil.

EXAMPLE NO. 4

| | |
|---|---|
| Goodyear Tire & Rubber Co. | 7.50 |
| Vitel ® PE-307 Polyester Resin | |
| Goodyear Tire & Rubber Co. | 3.22 |
| Vitel ® PE-200 Polyester Resin | |
| Cellosolve ® Acetate | 24.96 |
| Hydroquinone | 0.06 |
| Hooker Corp. Ferrophos ® 2131 | 32.13 |
| Di-Iron Phosphide | |
| Silver Flake | 32.13 |

Formulating procedure same as Example 1.
Results for 1 mil thick applied coating:
Electrical resistance of .105 ohms per square at 1 mil.

EXAMPLE NO. 5

| | |
|---|---|
| Goodyear Tire & Rubber Co. | 7.50 |
| Vitel ® PE-307 Polyester Resin | |
| Goodyear Tire & Rubber Co. | 3.22 |
| Vitel ® PE-200 Polyester Resin | |
| Cellosolve ® Acetate | 24.96 |
| Hydroquinone | 0.06 |
| Hooker Corp. Ferrophos ® 2131 | 38.56 |
| Di-Iron Phosphide | |
| Silver Flake | 25.70 |

Formulating procedure same as Example 1.
Results for 1 mil thick applied coating:
Electrical resistance of .217 ohms per square at 1 mil.

EXAMPLE NO. 6

| | |
|---|---|
| Goodyear Tire & Rubber Co. | 7.50 |
| Vitel ® PE-307 Polyester Resin | |
| Goodyear Tire & Rubber Co. | 3.22 |
| Vitel ® PE-200 Polyester Resin | |
| Cellosolve ® Acetate | 24.96 |
| Hydroquinone | 0.06 |
| Hooker Corp. Ferrophos ® 2131 | 44.98 |
| Di-Iron Phosphide | |
| Silver Flake | 19.28 |

Formulating procedure same as Example 1.
Results for 1 mil thick applied coating:
Electrical resistance of .738 ohms per square at 1 mil.

EXAMPLE NO. 7

| | |
|---|---|
| Goodyear Tire & Rubber Co. | 7.50 |
| Vitel ® PE-307 Polyester Resin | |
| Goodyear Tire & Rubber Co. | 3.22 |
| Vitel ® PE-200 Polyester Resin | |
| Cellosolve ® Acetate | 24.96 |
| Hydroquinone | 0.06 |
| Hooker Corp. Ferrophos ® 2131 | 51.41 |
| Di-Iron Phosphide | |

-continued

| | |
|---|---|
| Silver Flake | 12.85 |

Formulating procedure same as Example 1.
Results for 1 mil thick applied coating:
Electrical resistance of 5.06 ohms per square at 1 mil.

EXAMPLE NO. 8

| | |
|---|---|
| Goodyear Tire & Rubber Co. | 6.00 |
| Vitel ® PE-307 Polyester Resin | |
| Goodyear Tire & Rubber Co. | 2.60 |
| Vitel ® PE-222 Polyester Resin | |
| Hydroquinone | 0.14 |
| Cellsolve ® Acetate | 9.90 |
| Butyl Cellosolve ® Acetate | 10.00 |
| Silver Flake | 25.70 |
| Hooker Corp. Ferrophos ® 2131 | 25.70 |
| Di-Iron Phosphide | |

Formulating procedure same as Example 1.
Results for 1 mil thick applied coating:
Electrical resistance of .146 ohms per square at 1 mil.

EXAMPLE NO. 9

| | |
|---|---|
| Goodyear Tire & Rubber Co. | 6.00 |
| Vitel ® PE-307 Polyester Resin | |
| Goodyear Tire & Rubber Co. | 2.60 |
| Vitel ® PE-222 Polyester Resin | |
| Hydroquinone | 0.14 |
| Cellosolve ® Acetate | 9.90 |
| Butyl Cellosolve ® Acetate | 10.00 |
| Silver Flake | 25.70 |
| Iron Carbide | 25.70 |

Formulating procedure same as Example 1.
Results for 1 mil thick applied coating:
Electrical resistance of .131 ohms per square at 1 mil.

EXAMPLE NO. 10

| | |
|---|---|
| Goodyear Tire & Rubber Co. | 6.00 |
| Vitel ® PE-307 Polyester Resin | |
| Goodyear Tire & Rubber Co. | 2.60 |
| Vitel ® PE-222 Polyester Resin | |
| Hydroquinone | 0.14 |
| Cellosolve ® Acetate | 9.90 |
| Butyl Cellosolve ® Acetate | 10.00 |
| Silver Flake | 25.70 |
| Ferrotitanium | 25.70 |

Formulating procedure same as Example 1.
Results for 1 mil thick applied coating:
Electrical resistance of .108 ohms per square at 1 mil.

EXAMPLE NO. 11

| | |
|---|---|
| Goodyear Tire & Rubber Co. | 6.00 |
| Vitel ® PE-307 Polyester Resin | |
| Goodyear Tire & Rubber Co. | 2.60 |
| Vitel ® PE-222 Polyester Resin | |
| Hydroquinone | 0.14 |
| Cellosolve ® Acetate | 9.90 |
| Butyl Cellosolve ® Acetate | 10.00 |
| Silver Flake | 25.70 |
| Ferroboron | 25.70 |

Formulating procedure same as Example 1.
Results for 1 mil thick applied coating:
Electrical resistance of .163 ohms per square at 1 mil.

EXAMPLE NO. 12

| | |
|---|---|
| Goodyear Tire & Rubber Co. Vitel ® PE-307 Polyester Resin | 6.00 |
| Goodyear Tire & Rubber Co. Vitel ® PE-222 Polyester Resin | 2.60 |
| Hydroquinone | 0.14 |
| Cellosolve ® Acetate | 9.90 |
| Butyl Cellosolve ® Acetate | 10.00 |
| Silver Flake | 25.70 |
| Ferrovanadium | 25.70 |

Formulating procedure same as Example 1.
Results for 1 mil thick applied coating:
Electrical resistance of .122 ohms per square at 1 mil.

EXAMPLE NO. 13

| | |
|---|---|
| Goodyear Tire & Rubber Co. Vitel ® PE-307 Polyester Resin | 6.00 |
| Goodyear Tire & Rubber Co. Vitel ® PE-222 Polyester Resin | 2.60 |
| Hydroquinone | 0.14 |
| Cellosolve ® Acetate | 9.90 |
| Butyl Cellosolve ® Acetate | 10.00 |
| Silver Flake | 25.70 |
| Ferromanganese | 25.70 |

Formulating procedure same as Example 1.
Results for 1 mil thick applied coating:
Electrical resistance of .090 ohms per square at 1 mil.

EXAMPLE NO. 14

| | |
|---|---|
| Goodyear Tire & Rubber Co. Vitel ® PE-307 Polyester Resin | 6.00 |
| Goodyear Tire & Rubber Co. Vitel ® PE-222 Polyester Resin | 2.60 |
| Hydroquinone | 0.14 |
| Cellosolve ® Acetate | 9.90 |
| Butyl Cellosolve ® Acetate | 10.00 |
| Silver Flake | 25.70 |
| Ferrotungsten | 25.70 |

Formulating procedure same as Example 1.
Results for 1 mil thick applied coating:
Electrical resistance of .084 ohms per square at 1 mil.

EXAMPLE NO. 15

| | |
|---|---|
| Union Carbide Corp. VROH Vinyl Terpolymer Resin | 5.00 |
| Butyl Cellosolve ® Acetate | 20.00 |
| Silver Flake | 28.00 |
| Ferroboron | 12.00 |

Formulating procedure same as Example 1.
(Except Drawdown with 3.0 mil. Blade)
Results for 1 mil thick applied coating:
Electrical resistance of .063 ohms per square at 1 mil.

EXAMPLE NO. 16

| | |
|---|---|
| Rohm and Haas Co. Acryloid ® B48N Thermoplastic Acrylic Resin | 7.00 |
| Cellosolve ® Acetate | 16.30 |
| Silver Flake | 22.40 |
| Ferrovanadium | 6.00 |

Formulating procedure same as Example 1.
(Except Drawdown with 3.0 mil. Blade)
Results for 1 mil thick applied coating:
Electrical resistance of .332 ohms per square at 1 mil.

EXAMPLE NO. 17

| | |
|---|---|
| Union Carbide Corp. Phenolic resin BK-5918 | 10.00 |
| Propylene Glycol | 10.00 |
| Silver Flake | 30.00 |
| Ferromanganese | 20.00 |

Formulating procedure same as Example 1.
(Except Cure 30 minutes at 325° F.)
Results for 1 mil thick applied coating:
Electrical resistance of 3.25 ohms per square at 1 mil.

EXAMPLE NO. 18

| | |
|---|---|
| Spencer-Kellogg Polyol 8100-A4-80 Functional Resin | 10.5 |
| Cellosolve ® Acetate | 5.0 |
| Silver Flake | 42.0 |
| Ferroboride | 25.0 |

Formulating procedure same as Example 1.
(Except before use add Spencer-Kellogg Spenkel ® PSI-Al-75 Polyurethane Prepolymer and cure 30 minutes at 200° F.)
Results for 1 mil thick applied coating:
Electrical resistance of 1.17 ohms per square at 1 mil.

EXAMPLE NO. 19

| | |
|---|---|
| Spencer-Kellogg Polyol 8100-A4-80 Functional Resin | 10.0 |
| Cellosolve ® Acetate | 5.0 |
| Silver Flake | 42.0 |
| Ferroboride | 25.0 |

Formulating procedure same as Example 1.
(Except before use add Spencer-Kellogg Spenkel ® P81-Al-75 Polyurethane Prepolymer and cure by air drying for 72 hours)
Results for 1 mil thick applied coating:
Electrical resistance of 1.04 ohms per square at 1 mil.

EXAMPLE NO. 20

| | |
|---|---|
| Ciba-Geigy Corp. Araldite ® 506 Epoxy Resin | 5.5 |
| Ciba-Geigy Corp. Epoxide No. 7 Reactive Ether | 0.5 |
| Silver Flake | 14.9 |
| Ferrovanadium | 10.0 |

Formulating procedure same as Example 1.
(Except before use add:

| | |
|---|---|
| Ciba-Geigy Araldite ® HY 956 Amine Hardener | 1.1 |
| Ciba-Geigy XU 225 Amine Hardener | 0.1 |

Cure for 30 minutes at 200° F.)
Results for 1 mil thick applied coating:
Electrical resistance of 1.96 ohms per square at 1 mil.

EXAMPLE NO. 21

| | |
|---|---|
| Union Carbide Corp. VAGD Vinyl Resin | 10.5 |
| Butyl Cellosolve ® Acetate | 25.9 |
| Carbitol ® Acetate | 13.6 |
| Silver Flake | 22.5 |
| Hooker Corp. Ferrophos ® 2131 Di-Iron Phosphide | 30.0 |

Formulating procedure same as Example 1.
Results for 1 mil thick applied coating:
Electrical resistance of .394 ohms per square at 1 mil.

EXAMPLE NO. 22

| | |
|---|---|
| Rohm and Haas Co. | 7.0 |
| Acryloid ® B48N | |
| Thermoplastic Acrylic Resin | |
| Cellosolve ® Acetate | 16.3 |
| Silver Flake | 20.0 |
| Hooker Corp. Ferrophos ® 2131 | 36.0 |
| Di-Iron Phosphide | |
| Formulating procedure same as Example 1. | |
| Results for 1 mil thick applied coating: | |
| Electrical resistance of 5.42 ohms per square at 1 mil. | |

EXAMPLE NO. 23

| | |
|---|---|
| Union Carbide Corp. Phenolic resin BK-5918 | 10.00 |
| Propylene Glycol | 10.00 |
| Silver Flake | 30.00 |
| Hooker Corp. Ferrophos ® 2131 | 20.00 |
| Di-Iron Phosphide | |
| Formulating procedure same as Example 1. | |
| (Except cure 30 minutes at 325° F.) | |
| Results for 1 mil thick applied coating: | |
| Electrical resistance of .326 ohms per square at 1 mil. | |

EXAMPLE NO. 24

| | |
|---|---|
| Ciba-Geigy Corp. Araldite ® 506 Epoxy Resin | 5.5 |
| Ciba-Geigy Corp. Epoxide No. 7 | 0.5 |
| Reactive Ether | |
| Silver Flake | 14.9 |
| Hooker Corp. Ferrophos ® 2131 | 10.0 |
| Di-Iron Phosphide | |
| Formulating procedure same as Example 1. | |
| (Except before use add: | |
| Ciba-Geigy Araldite ® HY 956 Amine Hardener | 1.1 |
| Ciba-Geigy XU 225 Amine Hardener | 0.1 |
| Cure for 30 minutes at 200° F.) | |
| Results for 1 mil thick applied coating: | |
| Electrical resistance of .734 ohms per square at 1 mil. | |

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. A new silver-containing composition which is liquid when applied to a substrate, and forms an electrically conductive coating on the substrate, said composition being comprised of:

(a) a silver pigment material, said pigment being finely particulated and having an average particle size of about 50 microns or less, (b) a ferro alloy pigment material which is selected from at least one of the group consisting of ferrophosphorous, ferromanganese, ferromolybdenum, ferrosilicon, ferrochrome, ferrovanadium, ferrozirconium, ferrotitanium, ferrotungsten, ferroboron and ferrocarbide, said ferro alloy pigment material is present in amount of about 5% to about 90% by weight of the total solids, said ferro alloy pigment havng an average particle size of less than about 70 microns, (c) binder resin which is selected from at least one of the group consisting of thermoplastic acrylic, vinyl, urethane, alkyd, polyester, hydrocarbon, fluoroelastomer and cellulosic resins, and thermosetting acrylic, polyester, epoxy, phenolic, urethane and alkyd resins, (d) the pigment to binder weight ratio in said composition being between about 10 to 1 and about 4 to 1, and (e) said composition containing a weight percent total solids from about 50% to about 85% and an organic solvent carrier for the composition being used as required.

2. The composition of claim 1 further characterized in that said ferro alloy pigment material is di-iron phosphide.

3. The composition of claim 1 further characterized in that said ferro alloy pigment material is present in amount of about 20% to about 80% by weight of the total solids.

4. The composition of claim 1 further characterized in that said ferro alloy pigment material is present in amount of about 20% to about 70% by weight of the total solids.

5. The composition of claim 1 further characterized in that said composition additionally contains hydroquinone, said hydroquinone being present up to about 1% by weight of the total solids.

6. The composition of claim 1 further characterized in that said binder resin is a thermoplastic resin.

7. The composition of claim 1 further characterized in that said binder resin is a thermoplastic polyester resin.

8. The composition of claim 1 further characterized in that said composition enables the coating as applied to maintain an electrical conductivity between about 0.001 to about 30 ohms per square at 1 mil.

9. The composition of claim 1 further characterized in the said composition enables the coating composition as applied to maintain an electrical conductivity between about 0.001 to about 30 ohms per square at 1 mil.

10. The composition of claim 1 further characterized in that said composition enables the coating composition as applied to maintain an electrical conductivity between about 0.010 to about 5 ohms per square at 1 mil.

11. The composition of claim 1 further characterized in that said ferro alloy pigment material is present in amount of about 20% to about 70% by weight of the total solids and said pigment to binder weight ratio in said composition is between about 10 to 1 and about 4 to 1 and said composition enables the coating as applied to maintain an electrical conductivity between about 0.010 to about 5 ohms per square at 1 mil.

12. The composition of claim 11 further characterized in that said composition enables the coating as applied to maintain an electrical conductivity between about 0.020 to about 2 ohms per square at 1 mil.

13. The composition of claim 11 further characterized in that said pigment to binder weight ratio in said composition is between about 8 to 1 and about 5 to 1.

14. The composition of claim 11 further characterized in that said weight percent total solids in said composition is between about 60% and about 80%.

15. The composition of claim 1 further characterized in that said composition additionally contains hydroquinone, said hydroquinone being present up to about 1% by weight of the total solids.

16. The composition of claim 11 further characterized in that said composition additionally contains hydroquinone, said hydroquinone being present up to about 1% by weight of the total solids.

* * * * *